US007445525B2

(12) United States Patent
Kosuge

(10) Patent No.: US 7,445,525 B2
(45) Date of Patent: Nov. 4, 2008

(54) BATTERY TERMINAL

(75) Inventor: Shuji Kosuge, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/698,473

(22) Filed: Jan. 26, 2007

(65) Prior Publication Data

US 2007/0178773 A1 Aug. 2, 2007

(30) Foreign Application Priority Data

Jan. 31, 2006 (JP) ..... 2006-022775

(51) Int. Cl.
*H01R 4/42* (2006.01)

(52) U.S. Cl. ..... 439/762

(58) Field of Classification Search ..... 439/762, 439/761, 763, 764
See application file for complete search history.

(56) References Cited

U.S. PATENT DOCUMENTS 1,859,545 A * 5/1932 Wallenberg et al. ..... 439/388
2,068,452 A * 1/1937 Hansen ..... 439/761
2,215,415 A * 9/1940 Wolcott ..... 439/760
5,302,143 A * 4/1994 Inoue et al. ..... 439/762
6,234,849 B1 * 5/2001 Blanche ..... 439/764

FOREIGN PATENT DOCUMENTS

JP 2004-185979 7/2004

* cited by examiner

*Primary Examiner*—Gary F. Paumen
(74) *Attorney, Agent, or Firm*—Gerald E. Hespos; Anthony J. Casella

(57) ABSTRACT

A battery terminal (10, 10A) has an arcuate fitting (20) fittable on a battery post (80). Fasteners (40) extend out from opposite edges of an opening of the fitting (20) and face each other. A shaft (91) of a bolt (90) is inserted through holes (41) in the fasteners (40) and is tightened with a nut (95). Thus, the fasteners (40) approach each other and the fitting (20) is deformed inwardly for retention on the battery post (80). The head (92) of the bolt (90) contacts the outer circumferential surface of the fitting (20) so that the bolt (90) cannot turn as the nut (95) is turned. The fasteners (40) are sufficiently close to the fitting (20) for the head (92) of the bolt (90) to contact the outer circumferential surface of the fitting (20). Therefore the distance between the fasteners (40) and the fitting (20) is shortened.

13 Claims, 8 Drawing Sheets

BATTERY TERMINAL

BACKGROUND OF THE INVENTION

1. Field of the Invention

The invention relates to a battery terminal.

2. Description of the Related Art

Japanese Unexamined Patent Publication No. 2004-185979 relates to a battery terminal with a C-shaped fitting that fits on a battery post. Fasteners extend out from opposite ends of an opening of the C-shaped fitting and face each other in a direction oblique to the longitudinal direction of the fitting. Insertion holes are formed in the fastening portions and receive a bolt along an axis line that extends obliquely up. A nut is tightened on the bolt to bring the fasteners closer together. Thus, the fitting is deformed to a smaller diameter and can be held on the battery post. Notches are provided between the fitting and the fasteners, and a flange is bent from an upper or lower position on the fastener outward of the notches. The flange contacts the head of the bolt and prevents the bolt from turning with the nut.

The notches of the above-described terminal increase a distance between the fitting and the fasteners and enlarge the terminal transversely.

The invention was developed in view of the above situation and an object thereof is to realize the miniaturization of a battery terminal.

SUMMARY OF THE INVENTION

The invention relates to a battery terminal with a fitting to be fit on a battery post. The fitting has an opening and ends that oppose each other at the opening. Fasteners extend out from the ends of the fitting at the opening and face each other. The fasteners are formed with insertion holes. A bolt is inserted through the insertion holes and is tightened with a nut to bring the fasteners closer together. Thus, the fitting is deformed to a reduced diameter and is held on the battery post. The head of the bolt or the nut contact the outer circumferential surface of the fitting to prevent turning while the other of the nut and the bolt rotate.

The fasteners are brought closer together until one of the head of the bolt and the nut contacts the outer circumferential surface of the fitting. Thus, the distance between the fasteners and the fitting can be shortened more than before so that the battery terminal can be miniaturized. The outer circumferential surface of the fitting prevents the bolt head or the nut from turning while the other of the bolt head and the nut is rotated. Therefore the outer circumferential surface of the fitting functions as a stopper and the stopper construction can be simplified.

The fasteners preferably face each other in an oblique direction to the axial direction of the fitting. Thus, the longitudinal direction of the shaft of the bolt is along the oblique direction.

The oblique alignment of the fasteners and the bolt causes the connecting forces to have an upward component that acts on one of the two fasteners and a downward component that acts on the other. As a result, one fastener tries to displace up and the other tries to displace down, and there is a possibility of displacing the two fasteners relative to each other. A twisting force resulting from the displacements of the two fasteners could deform the fitting in a direction to be disengaged from the battery post. Accordingly, at least one pressing portion preferably is formed at an end of at least one fastener and extends in a manner for contacting an end of the other fastener. Thus, a vertical component of force acting on the other fastener is kept low as tightening is performed. As a result, the fasteners will not displace during tightening, and the fitting will not deform in a direction to disengage from the battery post.

A wire connecting portion preferably is provided substantially continuous with the fitting and at a position substantially opposite to an opening of the fitting along a lengthwise direction. The wire connecting portion preferably has at least one through hole in its area connected with the fitting.

At least one cut preferably is formed at the fitting so that one or both fasteners may be twisted utilizing the cut. In this way, the fasteners can be twisted even though the fasteners are connected directly with the fitting.

At least one recess preferably is formed in the inner circumferential surface of the fitting and extends substantially in the axis direction of the fitting. Portions of the fitting adjacent to the recess bite in the outer circumferential surface of the battery post when the fitting is fixed to the battery post.

At least one stopper preferably is provided on at least one fastener and an end edge of the stopper is spaced from the other fastener in a natural state. The stopper contacts the other fastener if the fasteners are tightened excessively to prevent the fasteners from being tightened further.

These and other objects, features and advantages of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

Figure 1:
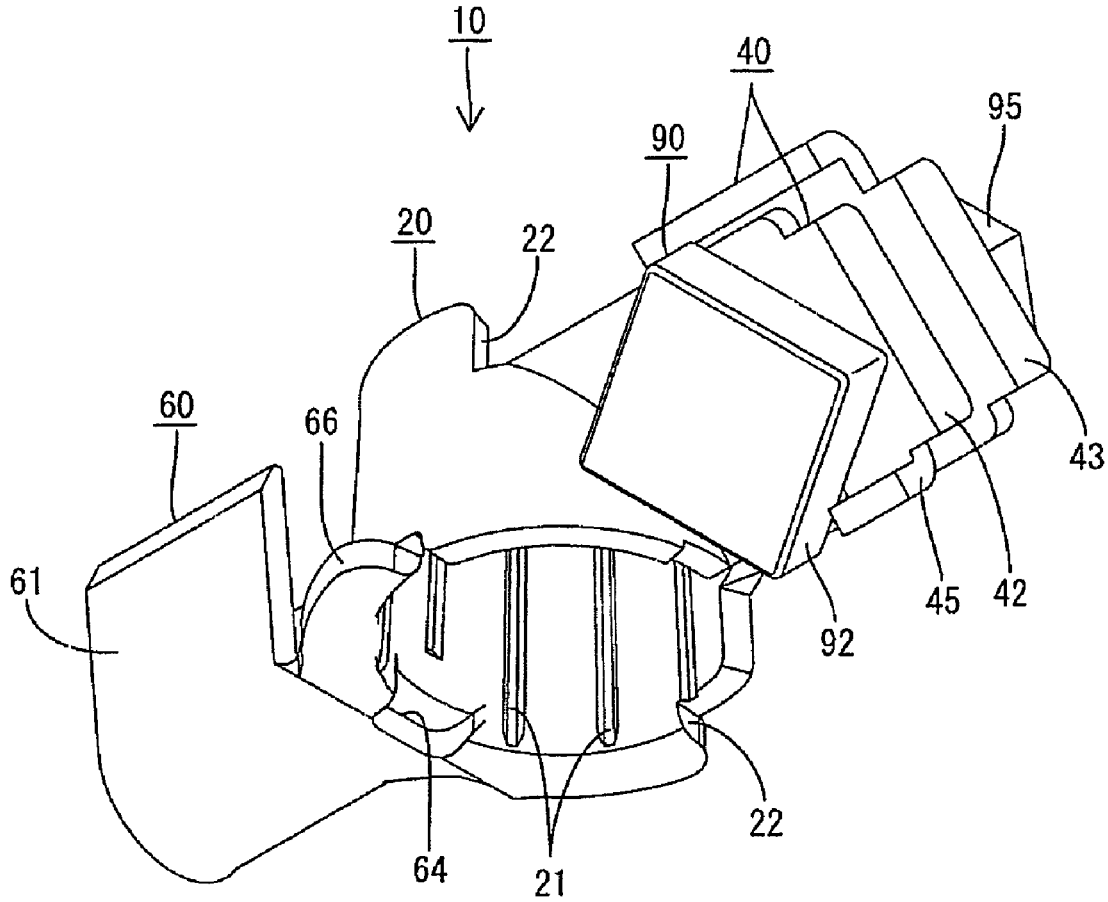
FIG. 1 is a perspective view of a battery terminal according to a first embodiment when viewed obliquely from below.
Figure 2:
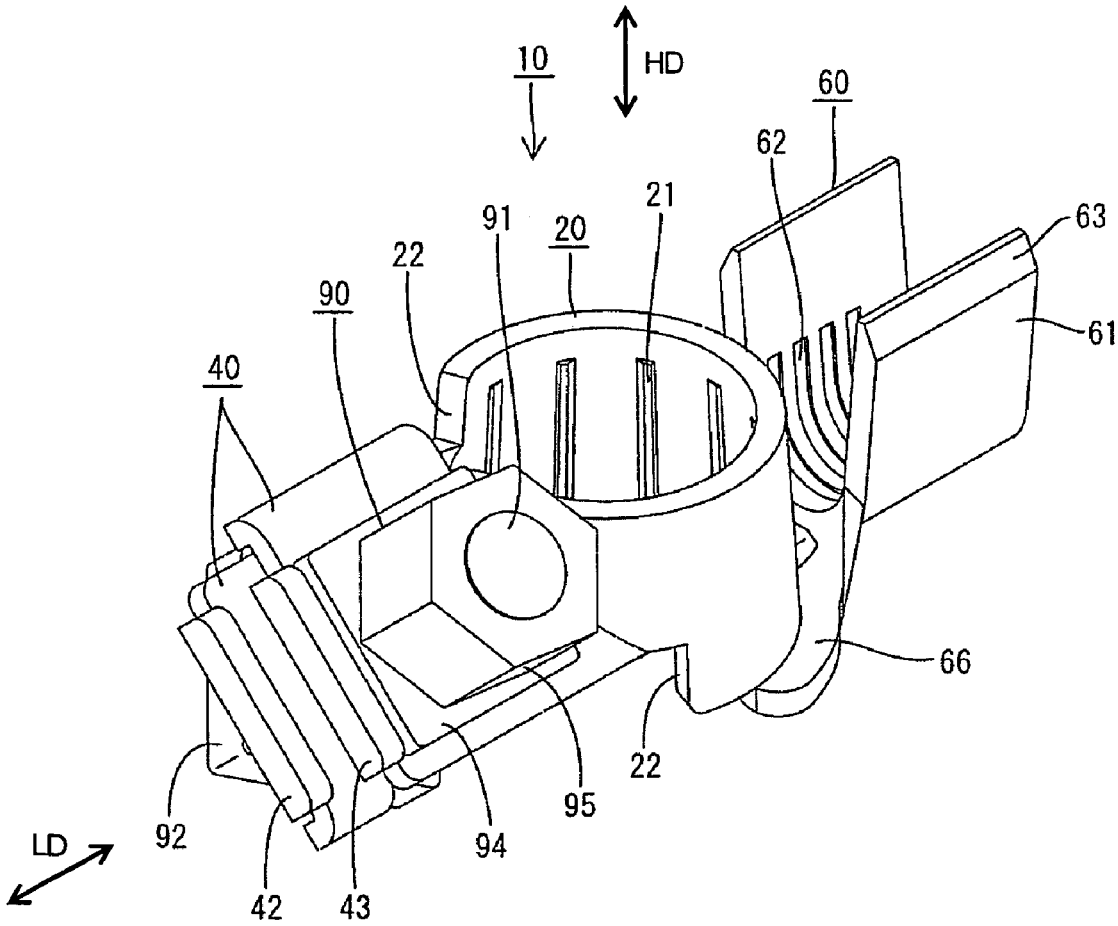
FIG. 2 is a perspective view of the battery terminal when viewed obliquely from above.
Figure 3:
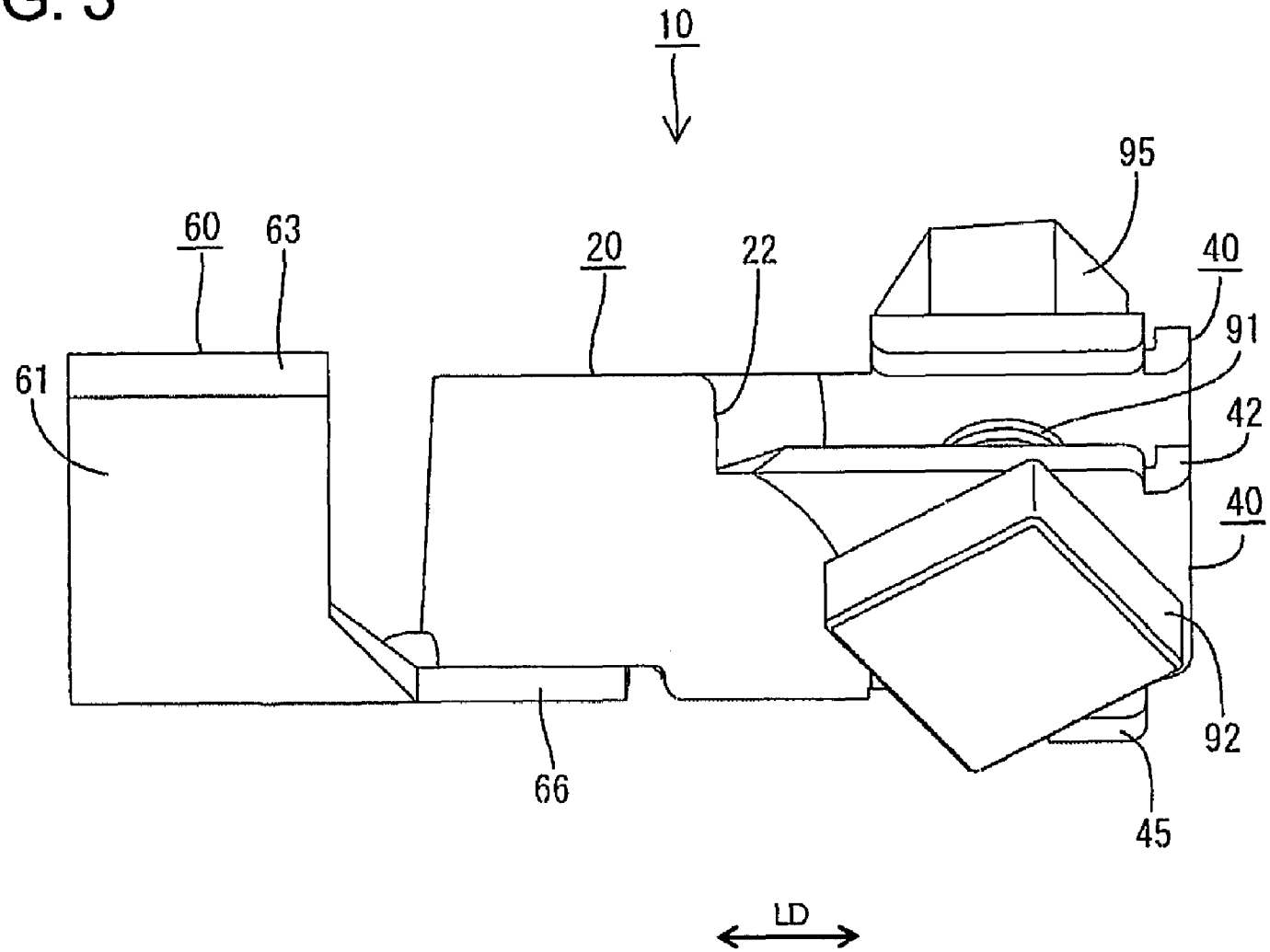
FIG. 3 is a front view of the battery terminal.

A battery terminal according to a first embodiment of the invention is identified by the numeral 10 in FIGS. 1 to 5. The battery terminal 10 is formed unitarily of an electrically conductive metal plate and includes a substantially C-shaped fitting 20 that is resiliently deformable in radial directions. The fitting 20, in a natural state, has a shape that is substantially complementary to the shape of a battery post 80, but with a slightly wider cross-section along an plane normal to a longitudinal axis LA of the battery post 80 at corresponding positions. For example, the battery post 80 may have a conical or frustum shape and the fitting 20 may have a similar or complementary conical or frustum shape with a similar or substantially identical inclination. The fitting 20 is fixed to the battery post 80 by reducing its diameter as explained herein. Recesses 21 are formed in the inner circumferential surface of the fitting 20 and extend substantially in the height direction HD, which is substantially parallel to the longitudinal axis LA of the battery post 80. Edges of the recesses 21 and portions of the fitting 20 adjacent to the recesses 21 bite into the outer circumferential surface of the battery post 80 when the fitting 20 is fixed to the battery post 80, thereby preventing the fitting 20 and the battery post 80 from turning relative to each other.

A wire connecting portion 60 is continuous with the bottom end of the fitting 20 at a position substantially opposite to an opening of the fitting 20, and extends in a longitudinal direction LD along a radius of the fitting 20. The wire connecting portion 60 includes a base plate 66 that projects radially out from the bottom end of the fitting 20 over an arc that preferably is more than about one third of the circumference of the fitting 20 and more preferably about half of the circumference. Two crimping pieces 61 extend substantially perpendicularly up from opposite sides of the base plate 66 at positions spaced out from the fitting 20 in the longitudinal direction LD, and are substantially opposed to each other. Thus, the crimping pieces 61 and the base plate 66 define a substantially U-shaped cross section when seen along the longitudinal direction LD. The crimping pieces 61 are to be crimped, bent or folded into connection with an end of an unillustrated wire. Recesses 62 are formed in the inner circumferential surfaces of the wire connecting portion 60 and extend substantially normal to the longitudinal direction LD to strongly hold the end of the wire. A slanted chamfered surface 63 is formed on the outer circumferential surface at the tip of each crimping piece 61 so that overlapping parts of the crimping pieces 61 do not form a large step when the crimping pieces 61 are wound around the wire. A through hole 64 is formed in the base plate 66 near the fitting 20 to facilitate deformation of the crimping pieces 61.

Two substantially plate-shaped fasteners 40 extend out from the opposite edges of the opening of the fitting 20 and are substantially parallel with each other. Insertion holes 41 penetrate the fasteners 40 and are substantially coaxial with one another. Thus, a shaft 91 of the bolt 90 can be inserted through the insertion holes 41 substantially along a fastening direction FD from a side of one of the fasteners 40. A substantially rectangular washer 94 is mounted on the shaft 91 of the bolt 90 coming out from the insertion hole 41 at the other side and a nut 95 is screwed down on the shaft 91 over the washer 94 to bring the fasteners 40 towards each other along the fastening direction FD. Accordingly, the fitting 20 deforms to reduce its diameter.

Figure 4:
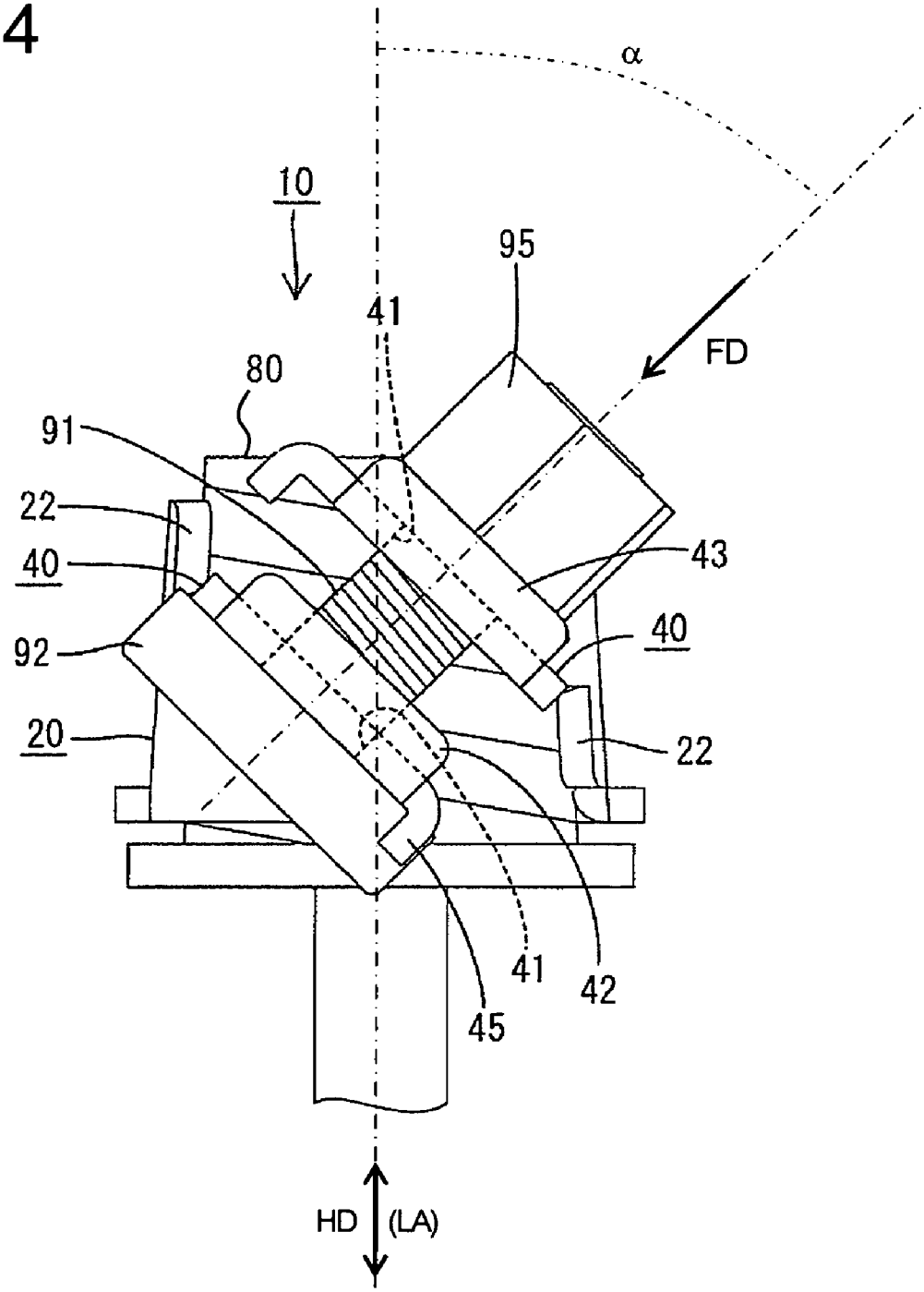
FIG. 4 is a side view of the battery terminal.
Figure 5:
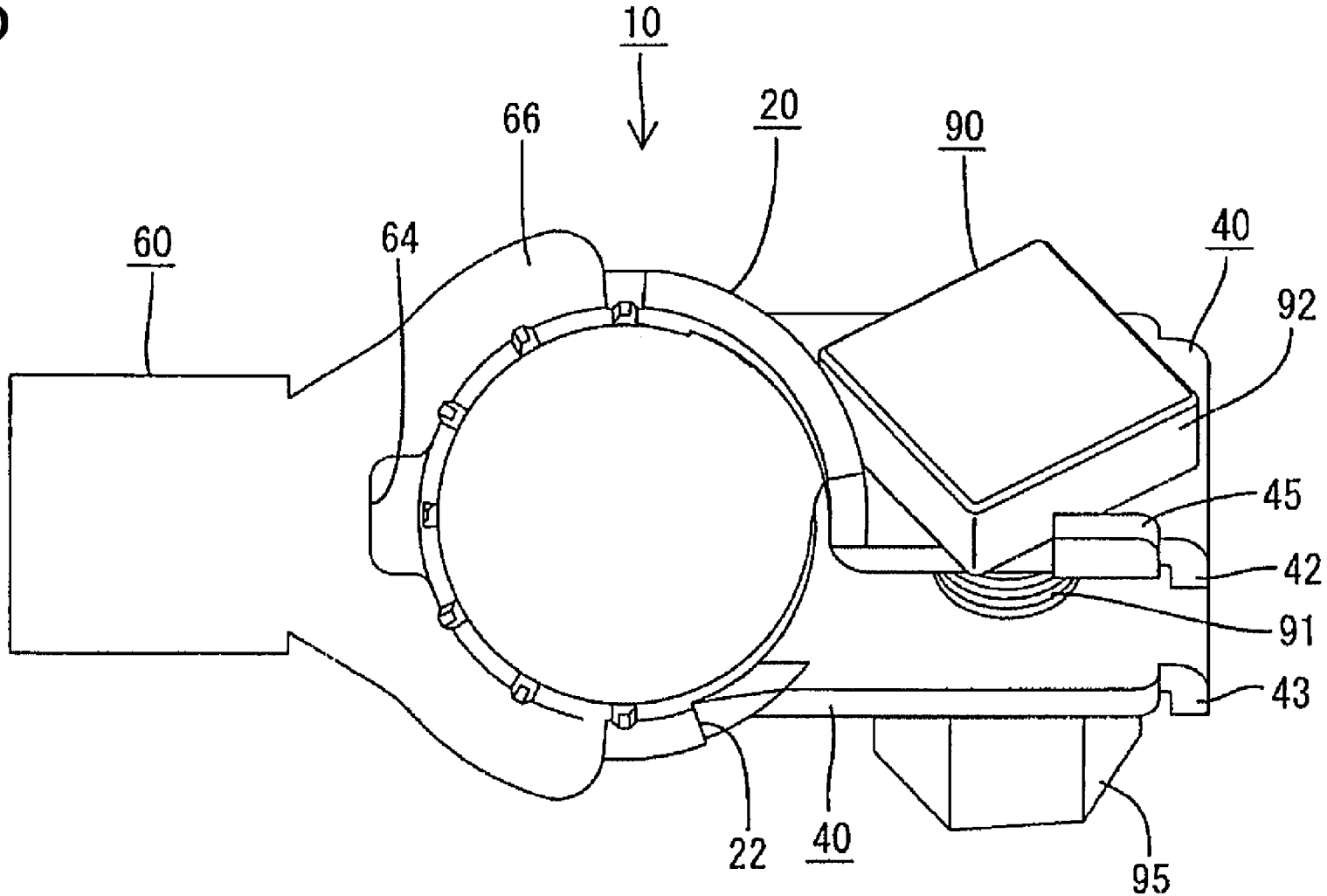
FIG. 5 is a bottom view of the battery terminal.

A stopper 42 is provided at the leading end of the left fastener 40 in FIG. 4. The stopper 42 is bent at a right angle from an end edge of the left fastener 40 and projects towards the right fastener 40. An end edge of the stopper 42 is spaced a specified distance from the inner surface of the right fastener 40 in a natural state. The end edge of the stopper 42 and the inner surface of the right fastener 40 contact each other if the fasteners 40 are tightened excessively, thereby preventing the fasteners 40 from being tightened further. A pressing piece 43 is arranged substantially parallel to the stopper 42 and has substantially the same shape as the stopper 42. The pressing piece 43 contacts one side of the washer 94 to position the washer 94 and prevents the washer 94 from turning.

The fasteners 40 are opposed and substantially parallel, but are inclined by an inclination angle $\alpha$ to the vertical direction, which is parallel to the axial direction AD of the fitting 20 and the battery post 80. The inclination angle $\alpha$ preferably is in a range between about 30° to about 60°. The fasteners 40 are inclined to be substantially normal to the fastening direction FD (e.g. twisted to left with respect to the vertical direction while facing the fitting 20 in FIG. 2) and the nut 95 is screwed down obliquely along the fastening direction FD on the shaft 91 of the bolt 90 from a right upper side.

A vertical cut 22 is formed at the upper end of the fitting 20 at the left edge of the opening of the fitting 20 near the wire connecting portion 60. The cut 22 enables the left fastener 40 to twist so that the base end of the left fastener 40 to come closer to the wire connecting portion 60 from the bottom end toward the upper end. On the contrary, a vertical cut 22 is formed at the bottom end of the fitting 20 at the right edge of the opening of the fitting 20 near the wire connecting portion 60. Thus, the base end of the right fastening portion 40 comes closer to the wire connecting portion 60 from the upper end toward the bottom end and in a direction substantially opposite to the left fastener 40. The cuts 22 at the upper and bottom positions of the connections of the fasteners 40 with the fitting 20 near the wire connecting portion 60 enables the fasteners 40 to be twisted even though the fasteners 40 are connected directly with the fitting 20.

The bolt 90 has a rectangular head 92 with a lateral edge that contacts the outer circumferential surface of the fitting 20 in a turning direction of the nut 95. Thus, the bolt 90 does not turn as the nut 95 is turned. A flange 45 extends substantially at a right angle from one lateral edge of the left fastener 40 along longitudinal direction LD, and the head 92 of the bolt 90 can contact an end edge of the flange 45 in the turning direction of the nut 95. The head 92 of the bolt 90 is prevented from turning while being positioned with respect to the left fastener 40 by the contact of the two adjacent lateral edges of the head 92 of the bolt 90.

The left fastener 40 has a surface area corresponding to the seating surface of the head 92 of the bolt 90 and is formed to be relatively smaller. The head 92 of the bolt 90 brought into contact with the left fastener 40 overlaps the fitting 20 with respect to lengthwise direction LD, and one corner thereof is closer to the wire connecting portion 60 than an end position of the fitting 20 with respect to lengthwise direction LD.

The shaft 91 of the bolt 90 is inserted along the fastening direction FD through the insertion holes 41 of both fasteners 40 to bring the head 92 of the bolt 90 into contact with the left fastener 40. The nut 95 then is fit loosely to the leading end of the shaft 91 of the bolt 90, and the fitting 20 is fit loosely on the battery post 80 in this state. The nut 95 then is screwed firmly down on the shaft 91 of the bolt 90. As a result, the head 92 of the bolt 90 and the outer circumferential surface of the fitting 20 and the flange 45 come into surface contact to prevent the bolt 90 and the washer 94 from turning. Both fasteners 40 are inclined transversely by the inclination angle $\alpha$ with respect to the vertical direction that is parallel to the axial direction AD of the fitting 20. Thus, the nut 95 can be tightened on the bolt 90 along the fastening direction FD that is inclined substantially by the same inclination angle $\alpha$ e.g. from an oblique upper side. Thus, the tightening operation can be performed more easily as compared to tightening in horizontal direction.

When the tightening operation is started, the right fastener 40 is pressed by the nut 95 and displaces obliquely down in the fastening direction FD along the longitudinal direction of the shaft 91 of the bolt 90. Simultaneously, the left fastener 40 is pressed by the head 92 of the bolt 90 and displaces obliquely up along the same fastening direction FD. Thus both fasteners 40 come closer to each other while being held substantially parallel. The fitting 20 gradually deforms to reduce the diameter as both fasteners 40 approach. As a result, the fitting 20 comes into close contact with the battery post 80 in the circumferential direction.

As described above, both fasteners 40 are brought closer to the fitting 20 until the head 92 of the bolt 90 contacts the outer circumferential surface of the fitting 20. Thus, distance between the fasteners 40 and the fitting 20 can be shortened remarkably to enable miniaturization of the battery terminal 10. The contact of the head 92 with the outer circumferential surface of the fitting 20 prevents the bolt 90 from turning even though the nut 95 is turned. Hence, the outer circumferential surface of the fitting 20 functions as a stopper to prevent the bolt 90 from turning, and the stopper construction is simplified.

Figure 6:
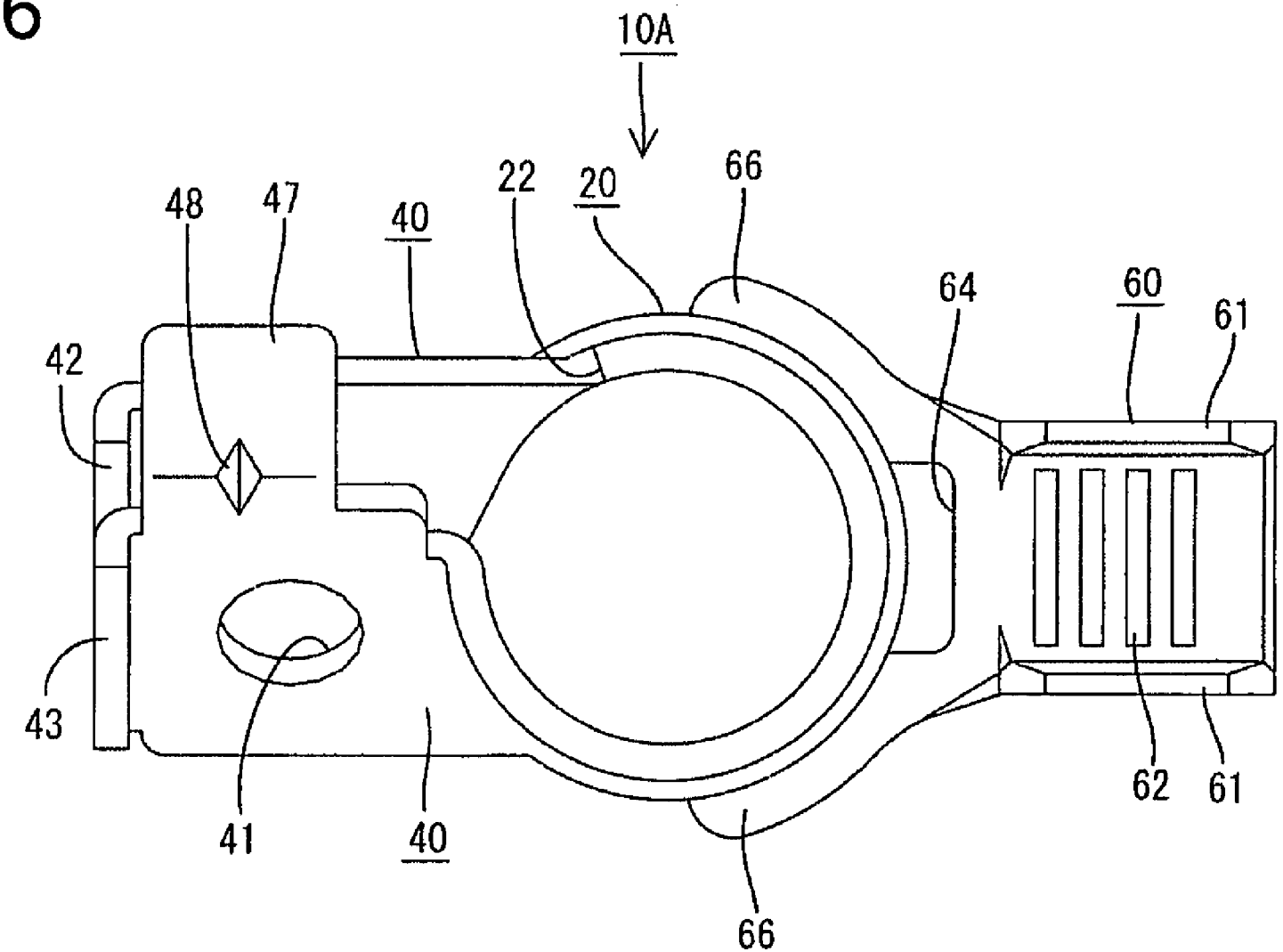
FIG. 6 is a plan view of a battery terminal before a bolt and a nut are tightened in a second embodiment.
Figure 7:
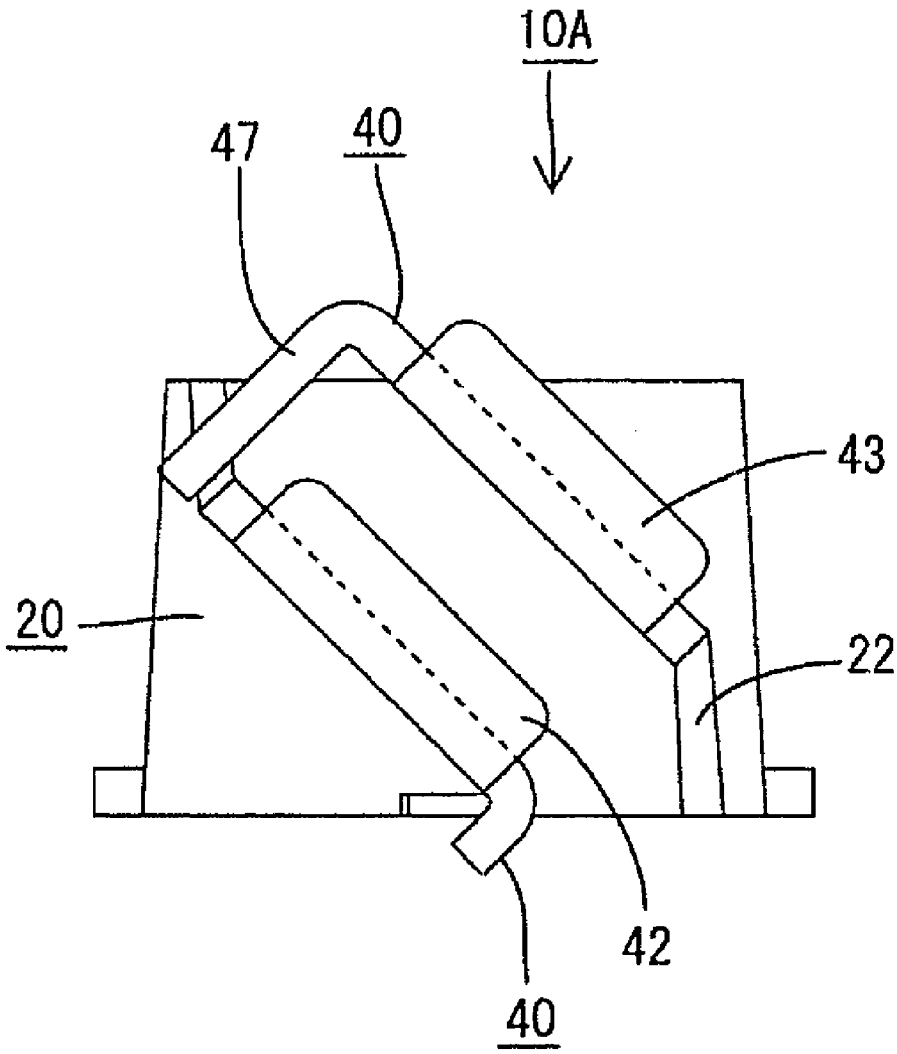
FIG. 7 is a side view of the battery terminal before the bolt and the nut are tightened.
Figure 8:
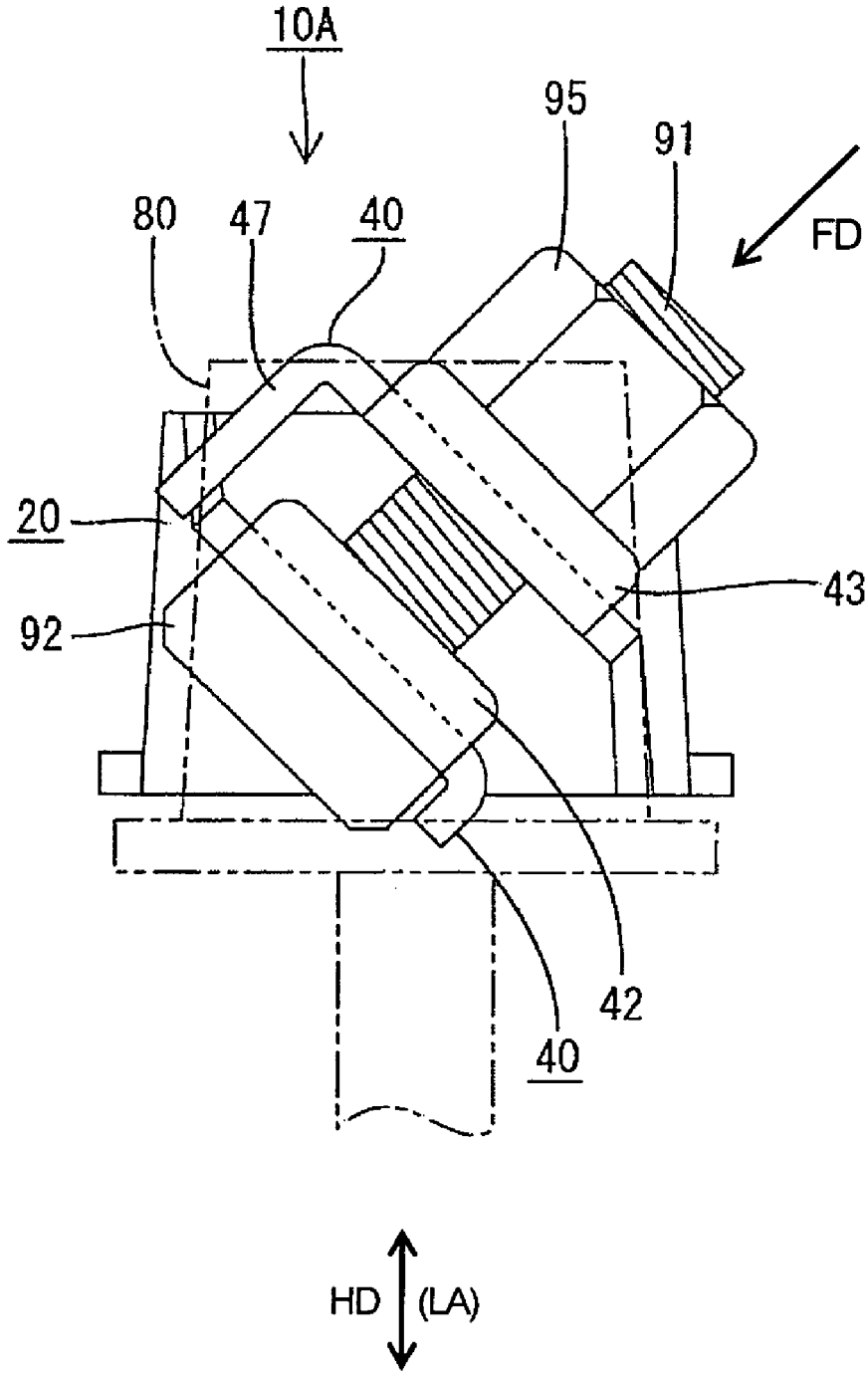
FIG. 8 is a side view of the battery terminal.

A battery terminal according to a second embodiment of the invention is identified by 10A in FIGS. 6 to 8. The battery terminal 10A of the second embodiment differs from the first embodiment in that the fasteners 40 have at least one pressing portion 47. The other construction is similar to the first embodiment, and elements that are identical or similar to the first embodiment are identified by the same reference numerals but are not described.

In the second embodiment, the right fastening portion 40 in FIG. 7 is provided with the pressing portion 47 extending to contact the upper edge of the first left fastener 40. The pressing portion 47 is a plate that extends continuously from the upper edge of the right fastening portion 40 at a substantially right angle towards the upper edge of the left fastener 40. A notch 48 is formed in a substantially widthwise center of the bent end of the pressing portion 47 to facilitate the bending.

The right fastener 40 is pressed by the nut 95 and is displaced obliquely down along the longitudinal direction of the shaft 91 of the bolt 90 and in the fastening direction FD when the fasteners 40 are fastened by the bolt 90 and the nut 95. Simultaneously, the head 92 of the bolt 90 presses the left fastener 40 and displaces the left fastener 40 obliquely up along the fastening direction FD and in the same longitudinal direction. In this case, a component of force acts vertically down on the right fastener 40 and a component of force acts vertically up on the left fastener 40 because both fasteners 40 are displaced obliquely along the fastening direction FD. Accordingly, if the shaft 91 of the bolt 90 is inserted loosely through the insertion holes 41 of both fasteners 40, a twisting force acts on the base ends of the fasteners 40. Therefore, the fitting 20 could displace up in a direction separating from the battery post 80 as the left fastener 40 is displaced. Then, a holding force of the battery terminal 10A on the battery post 80 would be reduced.

However, the pressing portion 47 at the upper edge of the right fastener 40 in the second embodiment contacts the upper edge of the left fastener 40 and keeps down the component of force acting vertically up on the left fastener 40. Thus, the fasteners 40 will not displace during tightening, and the fitting 20 will not deform. As a result, the holding force of the battery terminal 10A onto the battery post 80 can be kept constant.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The nut may be fixed and the bolt may be turned according to the invention. In such a case, the nut is prevented from turning by the contact with the outer circumferential surface of the fitting even if the bolt is turned during the tightening.

According to the invention, the bolt may be a hexagonal bolt or a polygonal bolt other than a rectangular bolt.

Converse to the foregoing embodiments, both fasteners may be twisted to right with respect to vertical direction (direction substantially parallel to the axial direction AD of the fitting) while facing the fitting.

Although the pressing portion is formed at the upper edge of the right fastener to extend from the upper edge in a manner to come into contact with the upper edge of the left fastener in the second embodiment, it may be formed at the bottom edge of the left fastening portion to extend from this upper edge in a manner to come into contact with the bottom edge of the right fastener according to the invention.

What is claimed is:

1. A battery terminal to be fit on a battery post that has a substantially frustum-shaped surface, comprising:

a frustum-shaped fitting having an open top, an open bottom and a split extending between the top and bottom, an inner surface extending from the top to the bottom and configured to be fit on the surface of the battery post, the fitting having an outer surface opposite the inner surface;

first and second fasteners extending out from the fitting at opposite sides of the split and substantially facing each other, the fasteners having insertion holes that substantially align with one another;

a bolt having a noncircular head and a shaft extending from the head, the shaft passing through the insertion holes in the fasteners; and a nut threaded on the shaft for urging the fasteners towards one another and deforming the fitting inwardly into engagement with the battery post, wherein one of the head of the bolt and the nut contacts the outer surface of the fitting to prevent rotation while the other of the bolt and the nut is rotated.

2. The battery terminal of claim 1, wherein the fitting is substantially generated about an axial direction, the fasteners defining planes that face each other in an oblique direction to the axial direction of the fitting, so that a longitudinal direction of the shaft of the bolt is along the oblique direction.

3. The battery terminal of claim 2, wherein a pressing portion is formed at an end of the first fastener and extends substantially in the oblique direction towards the second fastener.

4. The battery terminal of claim 3, wherein a wire connecting portion extends out from the bottom end of the fitting at a position substantially opposite to the split of the fitting.

5. The battery terminal of claim 4, further comprising at least one through hole in an area of a connection of the wire connecting portion with the fitting.

6. The battery terminal of claim 4, wherein a first cut is formed at the top end of the fitting substantially adjacent the first fastener and a second cut is formed at the bottom end of the fitting substantially adjacent the second fastener for generating twisting of the fasteners.

7. The battery terminal of claim 3, wherein at least one notch is formed in an intermediate position of a bent end of the pressing portion.

8. The battery terminal of claim 1, wherein recesses are formed in the inner circumferential surface of the fitting and extend substantially in an axial direction of the fitting.

9. The battery terminal of claim 8, wherein portions of the fitting adjacent to the recesses are configured to bite in an outer surface of the battery post when the fitting is fixed to the battery post.

10. The battery terminal of claim 1, wherein at least one stopper is provided at at least one fastener and an end edge of the stopper is substantially opposed at a specified distance to an inner surface of the other fastener in a natural state while contacting the other fastener to prevent excessive tightening of the fasteners.

11. A battery terminal to be fit on a battery post that has a substantially frustum-shaped surface, comprising:

a frustum-shaped fitting wall generated about a central axis, the fitting wall having an open top, an open bottom and a split extending between the top and bottom, an inner surface of the fitting wall being configured to be fit on the battery post;

first and second fasteners extending out from the fitting at opposite sides of the split and substantially facing each other, the fasteners having insertion holes that substantially align with one another, the fasteners defining planes that face each other in a direction oblique to the central axis of the fitting wall;

a bolt having a noncircular head and a shaft extending from the head, the shaft passing through the insertion holes in the fasteners;

a nut threaded on the shaft for urging the fasteners towards one another and deforming the fitting inwardly into engagement with the battery post; and a pressing portion formed at the side of the first fastener that extends transverse to the central axis of the fitting wall, the pressing portion extending substantially perpendicularly from the first fastener towards and into contact with an edge of the second fastener for preventing relative displacement of the first and second fasteners as the nut and the bolt are threaded into engagement with one another.

12. The battery terminal of claim 11, further comprising a notch extending from the first fastener to the pressing portion.

13. The battery terminal of claim 11, wherein one of the nut and the head of the bolt contacts and outer surface of the fitting wall.

* * * * *